US009259938B2

(12) United States Patent
Igarashi

(10) Patent No.: US 9,259,938 B2
(45) Date of Patent: Feb. 16, 2016

(54) LIQUID DISCHARGE TEST METHOD AND LIQUID DISCHARGE APPARATUS

(71) Applicant: BROTHER KOGYO KABUSHIKI KAISHA, Nagoya-shi, Aichi-ken (JP)

(72) Inventor: Akinori Igarashi, Kasugai (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/691,991

(22) Filed: Apr. 21, 2015

(65) Prior Publication Data

US 2015/0306885 A1 Oct. 29, 2015

(30) Foreign Application Priority Data

Apr. 24, 2014 (JP) ..... 2014-089726

(51) Int. Cl.
*B41J 29/393* (2006.01)
*B41J 2/175* (2006.01)

(52) U.S. Cl.
CPC ..... *B41J 2/17566* (2013.01)

(58) Field of Classification Search
USPC ..... 347/4–6, 9, 12–14, 16, 17, 19, 20–23, 347/25, 30, 40–44, 47, 68, 84–86, 96–98, 347/104, 105
See application file for complete search history.

(56) References Cited

U.S. PATENT DOCUMENTS 5,686,947 A 11/1997 Murray et al.
6,565,197 B1 5/2003 Murray et al.
7,703,867 B2 * 4/2010 Katsumura ..... B41J 2/17513 347/85
2002/0145650 A1 * 10/2002 Pan ..... B41J 2/17509 347/85
2005/0264624 A1 * 12/2005 Ogura ..... B41J 2/17509 347/86

FOREIGN PATENT DOCUMENTS

JP 11-504874 A 5/1999

* cited by examiner

*Primary Examiner* — Kristal Feggins
(74) *Attorney, Agent, or Firm* — Merchant & Gould PC

(57) ABSTRACT

There is provided a liquid discharge test method using a liquid discharge apparatus provided with a liquid storage tank and a liquid discharge unit, the method including: blocking communication between a first channel in a first channel forming member and a second channel in a second channel forming member; allowing the second channel to communicate with a third channel in a third channel forming member; discharging the liquid, which is supplied from the exterior liquid supply source through the third channel and the second channel, by the liquid discharge unit after blocking the communication between the first channel and the second channel and allowing the second channel to communicate with the third channel; blocking the communication between the second channel and the third channel after discharging the liquid; and allowing the first channel to communicate with the second channel after discharging the liquid.

8 Claims, 8 Drawing Sheets

LIQUID DISCHARGE TEST METHOD AND LIQUID DISCHARGE APPARATUS

CROSS REFERENCE TO RELATED APPLICATION

The present application claims priority from Japanese Patent Application No. 2014-089726, filed on Apr. 24, 2014, the disclosure of which is incorporated herein by reference in its entirety.

BACKGROUND

1. Field of the Invention

The present teaching relates to a liquid discharge test method for confirming whether or not liquid is discharged by a liquid discharge unit properly.

2. Description of the Related Art

There is conventionally known a printer of the ink-jet recording system in which an ink contained in a tank is discharged from a recording head. Before shipment of such a printer, a liquid discharge test for confirming whether or not the ink is discharged from the recording head properly is performed in some cases.

In the liquid discharge test, however, the following problems could occur when the ink to be discharged by the recording head is poured into the tank. First, there is fear that the residual ink which was not used in the liquid discharge test might be left in the tank. Further, there is fear that a user of the printer might feel discomfort on first use if the tank is contaminated with the ink. Furthermore, there is fear that the ink remained in the tank after the liquid discharge test might solidify to block a channel in the tank. It is, however, difficult to clean the inside of the tank perfectly.

SUMMARY

The present teaching has been made in view of the above-mentioned circumstances, and an object of the present teaching is to provide a liquid discharge test method which can be performed without pouring an ink into a tank.

According to a first aspect of the present teaching, there is provided a liquid discharge test method using a liquid discharge apparatus, which includes a liquid storage tank and a liquid discharge unit configured to discharge a liquid, the method including:

- blocking communication between a first channel in a first channel forming member extending from the liquid storage tank and a second channel in a second channel forming member extending from the liquid discharge unit;
- allowing the second channel to communicate with a third channel in a third channel forming member extending from an exterior liquid supply source in which the liquid is stored;
- discharging the liquid, which is supplied from the exterior liquid supply source through the third channel and the second channel, by the liquid discharge unit after blocking the communication between the first channel and the second channel and allowing the second channel to communicate with the third channel;
- blocking the communication between the second channel and the third channel after discharging the liquid; and
- allowing the first channel to communicate with the second channel after discharging the liquid.

In the above liquid discharge test method, the liquid supplied from the exterior liquid supply source through the third channel and the second channel is discharged by the liquid discharge unit. That is, the liquid discharge test can be performed without pouring the liquid in the liquid storage tank.

According to a second aspect of the present teaching, there is provided a liquid discharge apparatus configured to discharge a liquid, including:

- a liquid storage tank;
- a liquid discharge unit configured to discharge the liquid;
- a first channel forming member extending from the liquid storage tank to include a first channel formed therein;
- a second channel forming member extending from the liquid discharge unit to include a second channel formed therein; and
- a connection unit having a first attachment section, a second attachment section, and a third attachment section and being configured to allow an interior space of the connection unit to communicate with an outside of the connection unit through the first attachment section to which the first channel forming member is attached, the second attachment section to which the second channel forming member is attached, and the third attachment section which is closed by a removable closing member, wherein the connection unit is configured to allow the first channel of the first channel forming member attached to the first attachment section to communicate with the second channel of the second channel forming member attached to the second attachment section through the interior space.

BRIEF DESCRIPTION OF THE DRAWINGS

FIGS. 1A and 1B are perspective views of the outer appearances of a multifunction peripheral 10, wherein FIG. 1A depicts a state that a cover 70 is closed, and FIG. 1B depicts a state that the cover 70 is open.

FIGS. 8A to 8C depict attachment/detachment states of tubes 31B, 32B, 142B, and a cap 160B with respect to a connection unit 90B, wherein FIG. 8A depicts a state in which the first tube 31B is attached to a first attachment section 92B and the second tube 32B is attached to a second attachment section 93B, FIG. 8B depicts a state in which the first tube 31B is attached to the first attachment section 92B, the second tube 32B is attached to the second attachment section 93B, and the third tube 142B is attached to a third attachment section 94B, and FIG. 8C depicts a state in which the first tube 31B is attached to the first attachment section 92B, the second tube 32B is attached to the second attachment section 93B, and the cap 160B is attached to the third attachment section 94B.

DESCRIPTION OF THE EMBODIMENTS

Figure 1A:
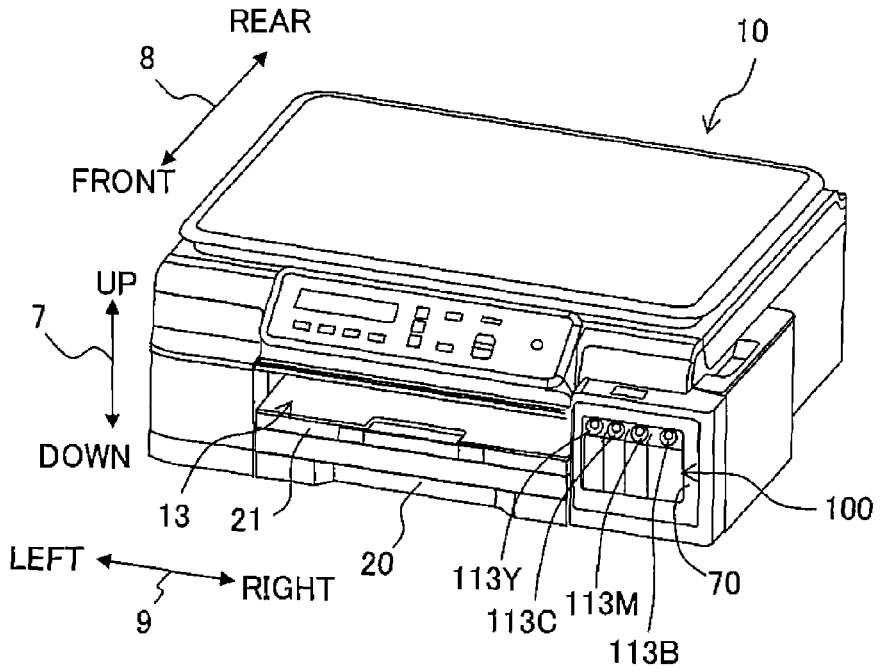

An explanation will be made about an embodiment of the present teaching. It is needless to say that the embodiment to be explained below is merely an example of the present teaching, and it is possible to appropriately change the embodiment of the present teaching without departing from the gist and scope of the present teaching. In the following explanation, the posture of a multifunction peripheral 10 in a state of being placed to be usable (the state depicted in FIG. 1) is referred to as "usable posture". An up-down direction 7 of the multifunction peripheral 10 is defined on the basis of the usable posture. A front-rear direction 8 of the multifunction peripheral 10 is defined as an opening 13 is provided on the near side (the front side). A left-right direction 9 of the multifunction peripheral 10 is defined as the multifunction peripheral 10 is viewed from the near side (the front side). The up-down direction 7 includes upward and downward directions as components thereof, and the upward direction is oriented against the downward direction. The left-right direction 9 includes leftward and rightward directions as components thereof, and the leftward direction is oriented against the rightward direction. The front-rear direction 8 includes frontward and rearward directions as components thereof, and the frontward direction is oriented against the rearward direction. Further in this embodiment, the up-down direction 7 corresponds to a vertical direction and the front-rear direction 8 and the left-right direction 9 correspond to a horizontal direction.

<Entire Structure of Multifunction Peripheral 10>

As depicted in FIG. 1, the multifunction peripheral 10 is formed to have an approximately cuboid form. The multifunction peripheral 10 includes a printer unit 11 of the ink-jet recording system provided at a lower part of the multifunction peripheral 10 to record an image on a sheet 12 (see FIG. 2). As depicted in FIG. 2, the printer unit 11 includes a feed unit 15, a feed tray 20, a discharge tray 21, a conveyance roller unit 54, a recording unit 24, a discharge roller unit 55, a platen 42, and an ink tank 100 (an exemplary tank). The multifunction peripheral 10 includes various functions such as a facsimile function and a print function. The multifunction peripheral 10 is an exemplary liquid discharge apparatus.

<Feed Tray 20, Discharge Tray 21>

As depicted in FIG. 1, the feed tray 20 is inserted to and pulled out from the multifunction peripheral 10 by a user in the front-rear direction 8, via the opening 13 which is formed at the front surface of the multifunction peripheral 10 in the central part in the left-right direction 9. The feed tray 20 can support a plurality of sheets 12 stacked thereon. The discharge tray 21 is disposed above the feed tray 20, and the discharge tray 21 is inserted to and pulled out from the multifunction peripheral 10 together with the feed tray 20. The discharge tray 21 supports each sheet 12 which is discharged by the discharge roller unit 55 from the space between the recording unit 24 and the platen 42.

<Feed Unit 15>

The feed unit 15 feeds each sheet 12 supported by the feed tray 20 to a conveyance path 65. As depicted in FIG. 2, the feed unit 15 includes a feed roller 25, a feed arm 26, and a shaft 27. The feed roller 25 is rotatably supported on the side of the forward end of the feed arm 26. The feed roller 25 is rotated by the reverse rotation of a conveyance motor (not depicted) in the direction in which the sheet 12 is conveyed in a conveyance direction 16. In the following, the rotations of the feed roller 25, the conveyance roller 60, and a discharge roller 62 in the direction in which the sheet 12 is conveyed in the conveyance direction 16 are referred to as "forward (normal) rotation". The feed arm 26 is swingably supported by the shaft 27 which is supported by a frame of the printer unit 11. The feed arm 26 is swingably biased toward the feed tray 20 by self-weight or the elastic force of a spring or the like.

<Conveyance Path 65>

Figure 2:
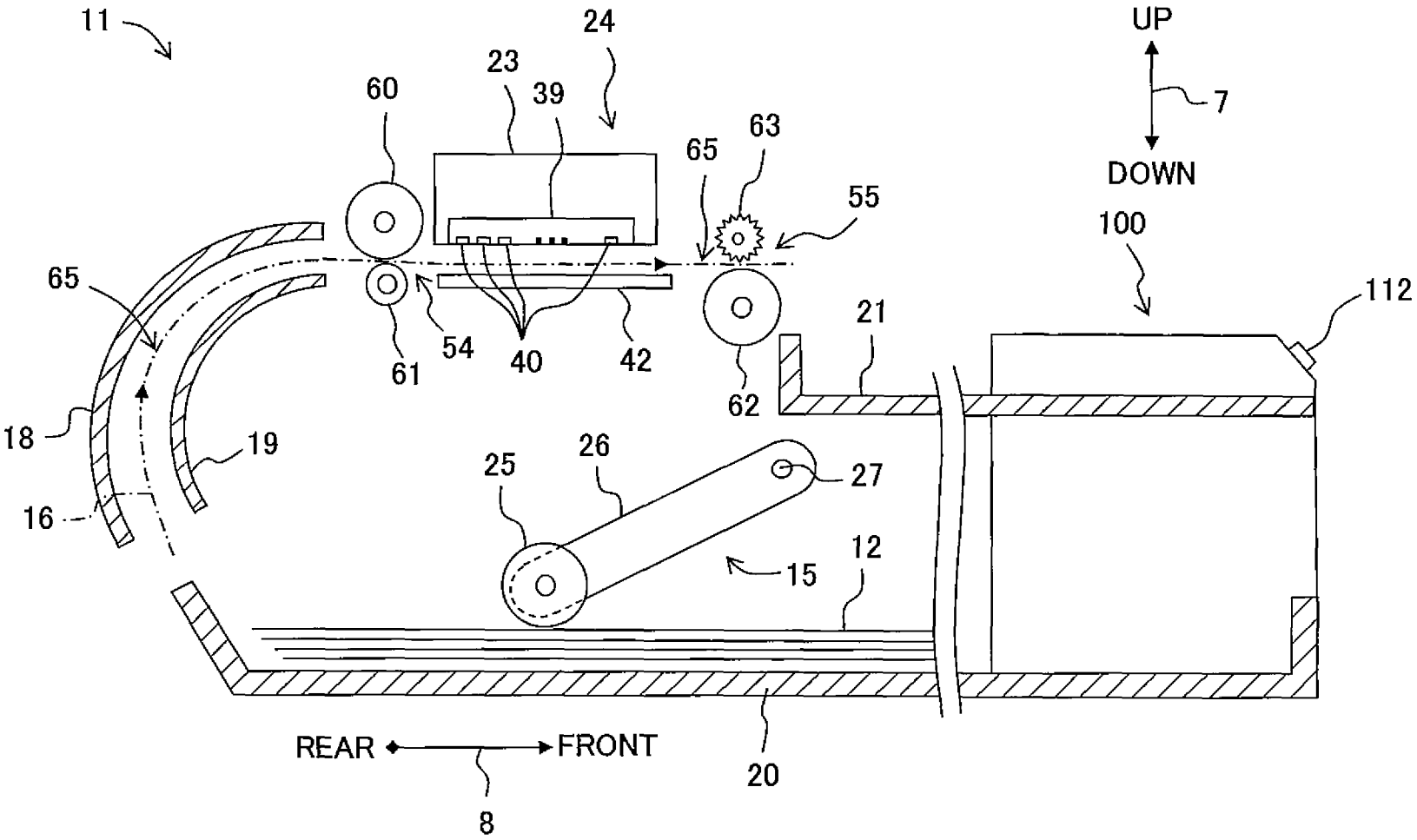
FIG. 2 is a vertical cross-sectional view schematically depicting an internal structure of a printer unit 11.
Figure 3:
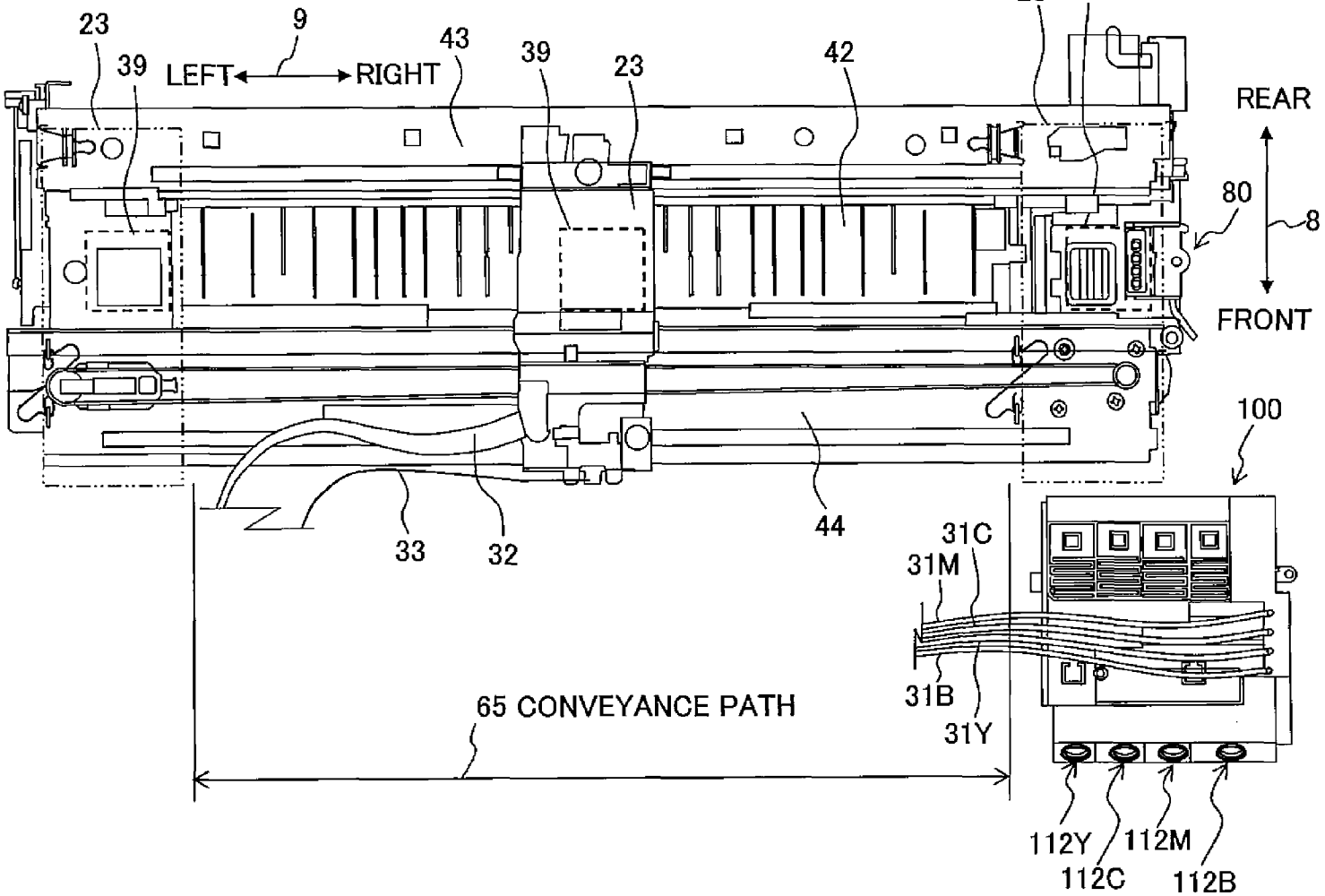
FIG. 3 is a plan view depicting an arrangement of a carriage 23 and an ink tank 100.

As depicted in FIG. 2, a part of the conveyance path 65 is formed as a space which is formed, in the printer unit 11, by an outer guide member 18 and an inner guider member 19 facing each other while being separated by a predetermined interval. The conveyance path 65 extends from the rear end of the feed tray 20 toward the rear side of the printer unit 11. Further, the conveyance path 65 extends from the lower side to the upper side at the rear side of the printer unit 11 while being curved to make a U-turn, and then passes through the space between the recording unit 24 and the platen 42 to arrive at the discharge tray 21. As depicted in FIGS. 2 and 3, a part of the conveyance path 65, which is positioned between the conveyance roller unit 54 and the discharge roller unit 55 in the front-rear direction 8, is provided substantially in the center of the multifunction peripheral 10 in the left-right direction 9 so that the part of the conveyance path 65 extends in the front-rear direction 8. The conveyance direction 16 of the sheet 12 in the conveyance path 65 is depicted by arrows indicated by dashed-dotted lines in FIG. 2.

<Conveyance Roller Unit 54>

As depicted in FIG. 2, the conveyance roller unit 54 is disposed on the upstream side of the recording unit 24 in the conveyance direction 16. The conveyance roller unit 54 includes the conveyance roller 60 and a pinch roller 61 facing each other. The conveyance roller 60 is driven by the conveyance motor. The pinch roller 61 is driven to rotate accompanying with the rotation of the conveyance roller 60. The sheet 12 is conveyed in the conveyance direction 16 while being held or nipped by the conveyance roller 60 and the pinch roller 61 those of which rotate in the forward direction due to the forward rotation of the conveyance motor.

<Discharge Roller Unit 55>

As depicted in FIG. 2, the discharge roller unit 55 is disposed on the downstream side of the recording unit 24 in the conveyance direction 16. The discharge roller unit 55 includes the discharge roller 62 and a spur roller 63 facing each other. The discharge roller 62 is driven by the conveyance motor. The spur roller 63 is driven to rotate accompanying with the rotation of the discharge roller 62. The sheet 12 is conveyed in the conveyance direction 16 while being held or nipped by the discharge roller 62 and the spur roller 63 those of which rotate in the forward direction due to the forward rotation of the conveyance motor.

<Recording Unit 24>

As depicted in FIG. 2, the recording unit 24 is disposed between the conveyance roller unit 54 and the discharge roller unit 55 in the conveyance direction 16. Further, the recording unit 24 is disposed to face the platen 42 in the up-down direction 7 with the conveyance path 65 intervening therebetween. That is, the recording unit 24 is disposed on the upper side of the conveyance unit 65 in the up-down direction 7 to face the conveyance unit 65. The recording unit 24 includes a carriage 23 and a recording head 39 (an exemplary liquid discharge unit).

As depicted in FIG. 3, the carriage 23 is supported by guide rails 43, 44 which are provided at positions separated in the front-rear direction 8 such that they extend in the left-right direction 9. The guide rails 43, 44 are supported by a frame of the printer unit 11. The carriage 23 is connected to a known belt mechanism provided for the guide rail 44. The belt mechanism is driven by a carriage motor (not depicted). That is, the carriage 23 connected to the belt mechanism reciprocates in the left-right direction 9 by the drive of the carriage motor. The carriage 23 moves leftward and rightward beyond the conveyance path 65 in the left-right direction 9 as depicted by dashed-dotted lines in FIG. 3.

A second tube 32 (an exemplary second channel forming member) and a flexible flat cable 33 lead from the carriage 23. The second tube 32 connects the ink tank 100 and the recording head 39, and the flexible flat cable 33 electrically connects a control board mounting a controller (not depicted) and the recording head 39. The second tube 32 includes a second channel formed therein through which the ink to be discharged from the recording head 39 passes. More specifically, four second tubes (not depicted), through which black, magenta, cyan, and yellow inks pass respectively, are connected to the carriage 23 in a state of being mutually bound. A control signal to be output from the controller is transmitted to the recording head 39 via the flexible flat cable 33.

As depicted in FIG. 2, the recording head 39 is carried on the carriage 23. A plurality of nozzles 40 are formed on the lower surface of the recording head 39. The tip portions of the nozzles 40 are exposed from the lower surfaces of the recording head 39 and the carriage 23 carrying the recording head 39. In the following, the surface from which the tip portions of the nozzles 40 are exposed is referred to as "nozzle surface" in some cases. The recording head 39 discharges the ink(s) from the nozzles 40 as minute or fine ink droplets. The recording head 39 discharges the ink droplets onto a sheet 12 supported by the platen 42 during the movement of the carriage 23. Accordingly, an image is recorded on the sheet 12.

<Platen 42>

As depicted in FIGS. 2 and 3, the platen 42 is disposed between the conveyance roller unit 54 and the discharge roller unit 55 in the conveyance direction 16. The platen 42 is disposed to face the recording unit 24 in the up-down direction 7 so as to support the sheet 12 conveyed by the conveyance roller unit 54 from the lower side of the sheet 12.

<Ink Tank 100>

Figure 1B:
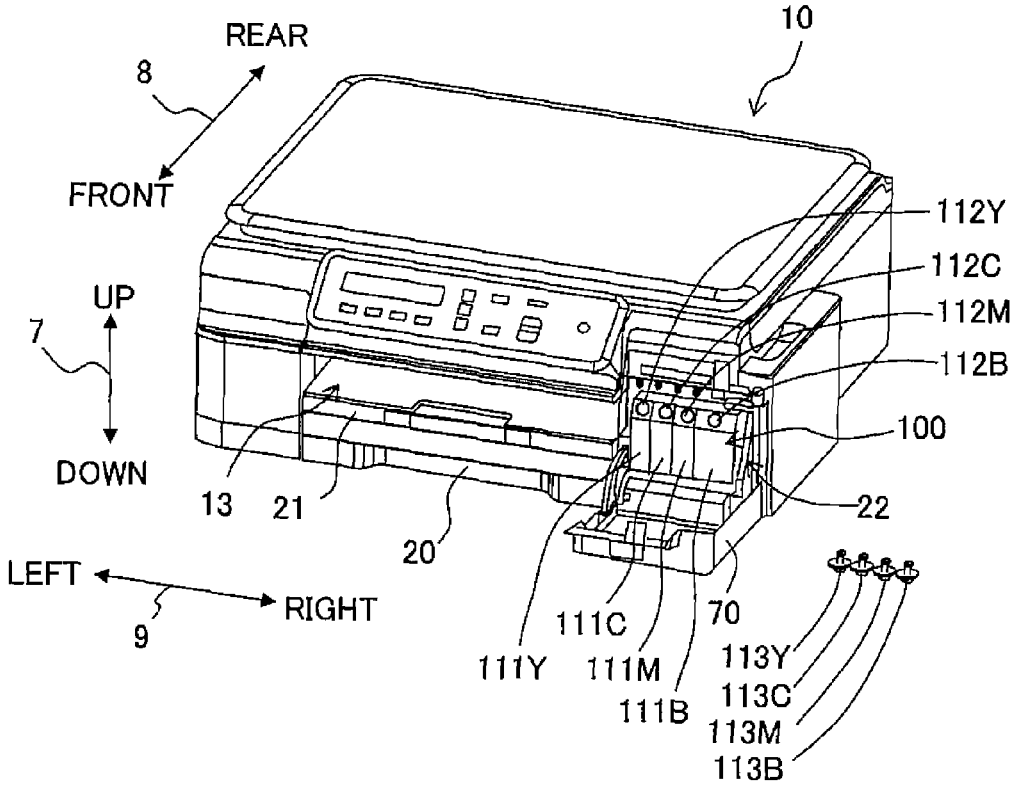

As depicted in FIG. 1, the ink tank 100 is accommodated in the multifunction peripheral 10. The ink tank 100 is fixed to the multifunction peripheral 10 so that the ink tank 100 is not removed from the multifunction peripheral 10 easily. The front surface of the ink tank 100 is exposed on the outside of the multifunction peripheral 10 via the opening 22, which is formed on the front surface of the multifunction peripheral 10 at the right end in the left-right direction 9. The opening 22 is adjacent to the opening 13 in the left-right direction 9. The multifunction peripheral 10 includes a cover 70 which is swingable between a covering position (see FIG. 1A) to cover the opening 22 therewith and an exposure position (see FIG. 1B) to expose the opening 22. The cover 70 is supported by the multifunction peripheral 10 to be swingable about the swing shaft extending in the left-right direction 9 at the lower end side in the up-down direction 7.

<Ink Chambers 111>

As depicted in FIG. 1, the interior of the ink tank 100 is divided into four ink chambers 111B, 111M, 111C, and 111Y which are adjacent to each other in the left-right direction 9 by use of partition walls (not depicted) partitioning the interior of the ink tank 100. Each of the ink chambers 111B, 111M, 111C, and 111Y is an exemplary liquid storage chamber for storing an ink to be discharged from the nozzles 40. In the following, the ink chambers 111B, 111M, 111C, and 111Y will be collectively referred to as "ink chambers 111" in some cases. Further, components or parts, which are respectively provided for the four ink chambers 111B, 111M, 111C, and 111Y, will be expressed by using reference numerals which have the same numeral and mutually different suffixes of B, M, C, and Y. In a case that the components or parts are expressed collectively, the suffixes (B, M, C, and Y) will be omitted in some cases.

Inks having different colors are stored in respective ink chambers 111. Specifically, a black ink is stored in the ink chamber 111B, a cyan ink is stored in the ink chamber 111C, a magenta ink is stored in the ink chamber 111M, and a yellow ink is stored in the ink chamber 111Y. Each of the color inks is an exemplary liquid. However, the number of ink chambers 111 and the colors of inks are not limited to the above examples. As depicted in FIG. 3, first tubes 31B, 31M, 31C, and 31Y (examples of a first channel forming member) lead from the ink tank 100. Each of the first tubes 31 includes a first channel formed therein through which one of the inks flows from the corresponding ink chamber 111.

<Inlets 112>

Inlets 112B, 112M, 112C, and 112Y from which inks are poured into respective ink chambers 111 are provided on the front surface of the ink tank 100. The inlets 112 penetrate the front surface of the ink tank 100 in its thickness direction to allow respective ink chambers 111 to communicate with the outside of the ink tank 100. As depicted in FIG. 1B, in a case that the cover 70 is in the exposure position, the inlets 112 are exposed to the outside of the multifunction peripheral 10 through the opening 22. In this embodiment, the posture of the ink tank 100 (the posture for pouring the ink) taken when the inks are poured into the ink chambers 111 through the inlets 112 is coincident with the usable posture of the ink tank 100 taken when the multifunction peripheral 10 is used.

The ink tank 100 includes caps 113B, 113M, 113C, and 113Y which are attachable/detachable with respect to respective inlets 112. As depicted in FIG. 1A, the caps 113 attached to the inlets 112 are brought in tight contact with the peripheries of the inlets 112 to close the inlets 112. Meanwhile, as depicted in FIG. 1B, detaching the caps 113 from the inlets 112 opens the inlets 112. The caps 113 are attached/detached with respect to the inlets 112 in a state that the cover 70 is in the exposure position. Inks can be poured into the ink chambers 111 by removing the caps 113 from the inlets 112.

<Maintenance Mechanism 80>

Figure 4:
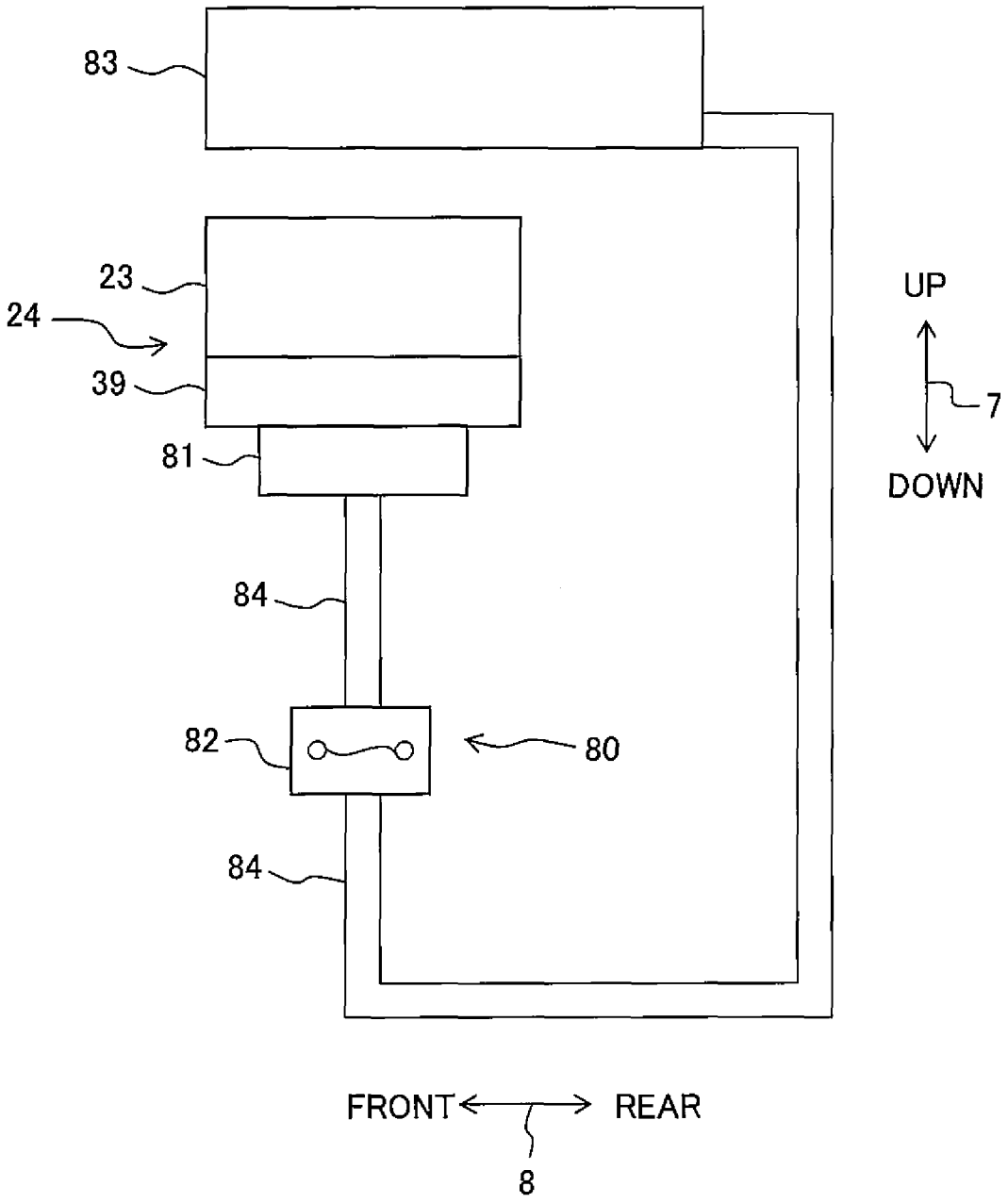
FIG. 4 schematically depicts a maintenance mechanism 80.

The multifunction peripheral 10 further includes a maintenance mechanism 80 depicted in FIG. 4. As depicted in FIG. 3, the maintenance mechanism 80 is disposed on the right side of the right end of the conveyance path 65 in the left-right direction 9. The maintenance mechanism 80 includes a cap 81, a pump 82, a drainage pump 83, and a tube 84. The maintenance mechanism 80 performs a purge operation for sucking the ink, air, and the like (hereinafter referred to collectively as "ink and the like") in the nozzles 40.

The cap 81 is made of rubber. The cap 81 is provided to face the carriage 23, which is positioned on the right side of the conveyance path 65, in the up-down direction 7. The cap 81 is configured to be movable between a cap position and an uncap position by a lifting mechanism (not depicted). In the cap position, the upper end of the cap 81 makes contact with the nozzle surface to form an enclosed space between the upper end of the cap 81 and the nozzle surface. In the uncap position, the cap 81 is away from the nozzle surface. The pump 82 is, for example, a rotary tube pump. Driving the pump 82 makes the enclosed space between the cap 81 in the cap position and the nozzle surface have negative pressure. Then, the ink and the like in the nozzles 40 are discharged into the drainage pump 83 through the cap 81, the tube 84, and the pump 82.

<Connection Units 90>

The multifunction peripheral 10 further includes connection units 90B, 90M, 90C, and 90Y as depicted in FIG. 5 and FIGS. 8A to 8C. The position where the connection units 90 are provided is not particularly limited, but it is desirable that the connection portions 90 be provided at a position where a user can easily access the connection units 90 from the outside of the multifunction peripheral 10. The four connection units 90B, 90M, 90C, and 90Y have the same structure, and thus an explanation will be made in detail about the connection unit 90B corresponding to black ink. The connection unit 90B includes a cylindrical section 91B, a first attachment section 92B, a second attachment section 93B, and a third attachment section 94B those of which allow the interior space of the cylindrical section 91B to communicate with the outside of the connection unit 90B.

The space having a cylindrical shape is formed in the cylindrical section 91B. The cylindrical section 91B is supported by the multifunction peripheral 10 so that the axis direction of the cylindrical section 91B extends in the up-down direction 7 and that the radial direction of the cylindrical section 91B extends in the front-rear direction 8 and the left-right direction 9. Openings 95B and 96B are provided at the side surface of the cylindrical section 91B. An opening 97B is provided at the upper surface of the cylindrical section 91B. The interior space of the cylindrical section 91B may communicate with the outside of the cylindrical section 91B through the openings 95B, 96B, and 97B.

The first attachment section 92B is formed such that the first attachment section 92B surrounds the opening 95B and protrudes outward from the side surface of the cylindrical section 91B in the radial direction. The first attachment section 92B has a cylindrical shape and the protruding tip portion of the first attachment section 92B is open. That is, the interior space of the cylindrical section 91B communicates with the outside of the connection unit 90B through the opening 95B and the interior space of the first attachment section 92B. The outer diameter of the first attachment section 92B is greater than the inner diameter of the first tube 31B. The distal end of the first tube 31B (the end of the first tube 31B on the downstream side in an ink flow direction) is attached to the first attachment section 92B. Then, the first channel in the first tube 31B communicates with the interior space of the cylindrical section 91B through the opening 95B and the interior space of the first attachment section 92B.

The second attachment section 93B is formed such that the second attachment section 93B surrounds the opening 96B and protrudes outward from the side surface of the cylindrical section 91B in the radial direction. The second attachment section 93B has a cylindrical shape and the protruding tip portion of the second attachment section 93B is open. That is, the interior space of the cylindrical section 91B communicates with the outside of the connection unit 90B through the opening 96B and the interior space of the second attachment section 93B. The outer diameter of the second attachment section 93B is greater than the inner diameter of the second tube 32B. The distal end of the second tube 32B (the end of the second tube 32B on the upstream side in the ink flow direction) is attached to the second attachment section 93B. Then, the second channel in the second tube 32B communicates with the interior space of the cylindrical section 91B through the opening 96B and the interior space of the second attachment section 93B.

The third attachment section 94B defines the periphery of the opening 97B. That is, the interior space of the cylindrical section 91B is exposed to the outside of the connection unit 90B through the opening 97B. A joint 143B of a third tube 142B which will be described later or a joint 153B of a fourth tube 152B is connected to the third attachment section 94B. Then, a third channel in the third tube 142B or a fourth channel in the fourth tube 152B communicates with the interior space of the cylindrical section 91B through the opening 97B. A cap 160B which will be described later is attached to the third attachment section 94B. This closes the opening 97B.

In this embodiment, the openings 95B, 96B are provided at mutually different positions in the up-down direction 7. More specifically, the opening 95B is provided below the opening 96B (the side farther away from the opening 97B). In other words, the opening 96B is provided above the opening 95B (the side closer to the opening 97B). Further, the openings 95B, 96B are provided at mutually different positions in the circumferential direction of the cylindrical section 91B. Therefore, the first attachment section 92B and the second attachment section 93B are provided in the cylindrical section 91B at mutually different positions in the up-down direction 7 and the circumferential direction. Although the boundary between the cylindrical section 91B and the third attachment section 94B is not clearly defined in this embodiment, the third attachment section 94B is a part, of the cylindrical section 91B, to which the joint 143B or the joint 153B is attached (in other words, a part, of the cylindrical section 91B, which holds the joint 143B or the joint 153B).

In this embodiment, the interior space of the cylindrical section 91B, the interior space of the first attachment section 92B, and the interior space of the second attachment section 93B form the interior space of the connection unit 90B. Although the connection units 90B, 90M, 90C, and 90Y are configured as one structure in this embodiment, the interior spaces of the connection units 90B, 90M, 90C, and 90Y do not communicate with one another. It is not necessarily indispensable to configure the connection units 90B, 90M, 90C, and 90Y as one structure, and the connection units 90B, 90M, 90C, and 90Y may be configured separately from each other.

<Exterior Ink Supply Source 140, Exterior Cleaning Liquid Supply Source 150>

In a liquid discharge test which will be described later, there are used, for example, an exterior ink supply source 140 (an exemplary exterior liquid supply source) depicted in FIG. 6A and an exterior cleaning liquid supply source 150 depicted in FIG. 6B. The exterior ink supply source 140 and the exterior cleaning liquid supply source 150 are configured separately from the multifunction peripheral 10, and each of them is connected to the connection units 90 at the time of the liquid discharge test.

Figure 6B:
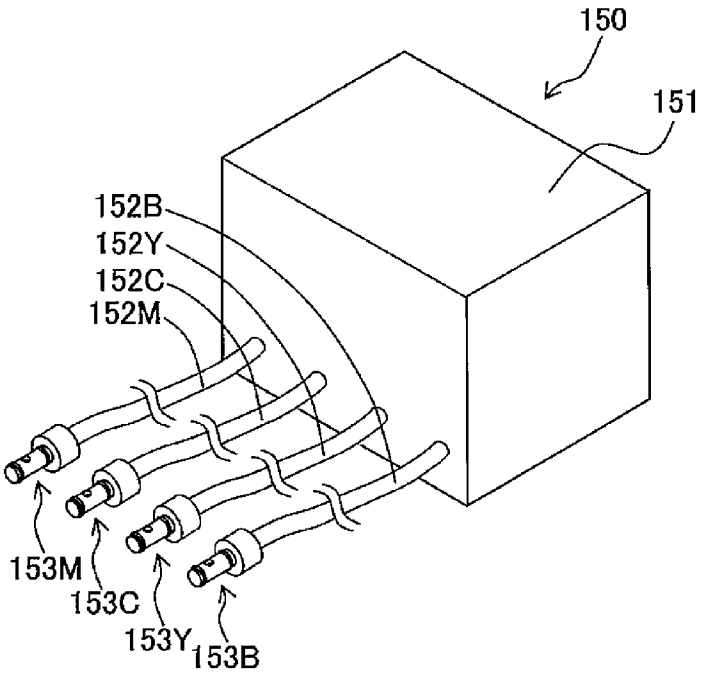
FIG. 6B is a perspective view of the outer appearance of an exterior cleaning liquid supply source 150.
Figure 6A:
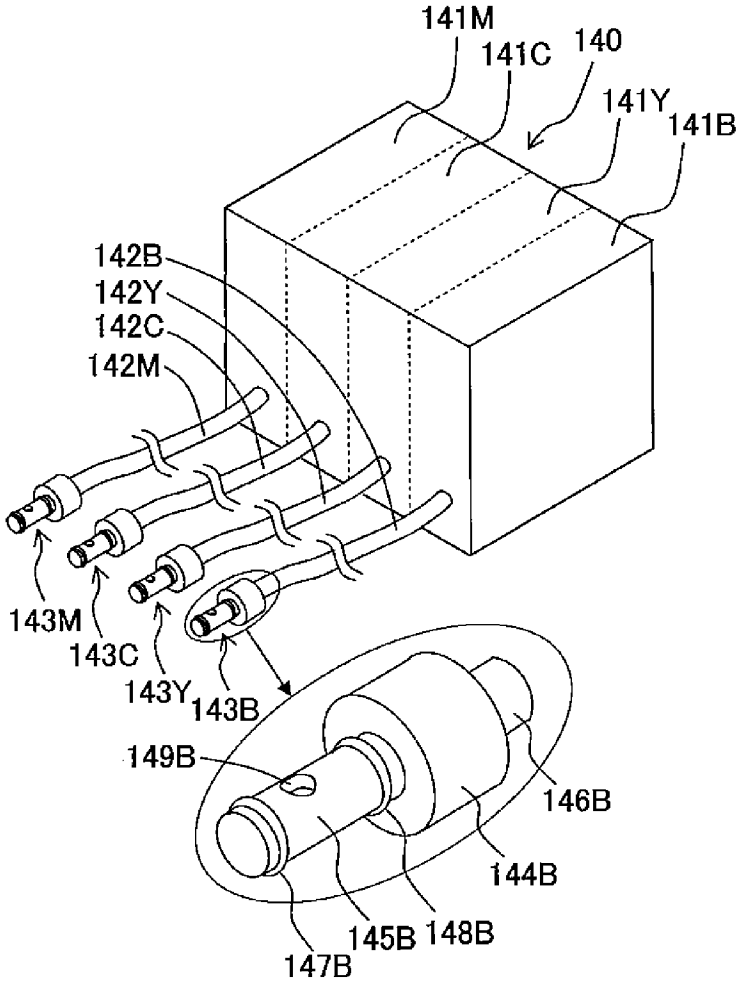
FIG. 6A is a perspective view of the outer appearance of an exterior ink supply source 140.

As depicted in FIG. 6A, the exterior ink supply source 140 includes storage chambers 141B, 141Y, 141C, and 141M those of which are formed in the exterior ink supply source 140 to store inks having respective colors. The inks stored in the storage chambers 141B, 141Y, 141C, and 141M may be the same as the inks stored in the ink chambers 111B, 111Y, 111C, and 111M, respectively. The third tubes 142B, 142Y, 142C, and 142M (examples of a third channel forming member), through which the inks in respective storage chambers 141 flow, lead from the exterior ink supply source 140. The third channel through which the ink flows is formed in each of the third tubes 142.

The joints 143B, 143Y, 143C, and 143M are attached to the distal ends of the third tubes 142 (the ends of the third tubes 142 on the downstream side in the ink flow direction). The joint 143B is constructed of a large diameter portion 144B and small diameter portions 145B, 146B. The large diameter portion 144B and the small diameter portions 145B, 146B have substantially cylindrical shapes, respectively. The outer diameter of the large diameter portion 144B is greater than the outer diameters of the small diameter portions 145B, 146B. The small diameter portion 145B protrudes from one end surface of the large diameter portion 144B, and the small diameter portion 146B protrudes from the other end surface of the large diameter portion 144B. The joints 143B, 143Y, 143C, and 143M have the same structure.

The small diameter portion 145B includes seal sections 147B, 148B and an opening 149B. The seal sections 147B, 148B protrude outward from the outer surface of the small diameter portion 145B in the radial direction to be continuous therewith in the circumferential direction. The opening 149B allows the interior space of the joint 143B to communicate with the outside. The seal sections 147B, 148B are, for example, O rings which fit onto the small diameter portion 145B. The seal sections 147B, 148B are provided in the small diameter portion 145B at mutually different positions in the protruding direction. The opening 149B is provided between the seal sections 147B and 148B in the protruding direction of the small diameter portion 145B. The protruding end of the small diameter portion 146B is open (not depicted).

The interior space of the large diameter portion 144B and the interior spaces of the small diameter portions 145B, 146B (hereinafter collectively referred to as "interior space of the joint 143B" in some cases) communicate with each other. The small diameter portion 145B is attached to the third attachment section 94B of the connection unit 90B. The diameter of the opening 97B is larger than the outer diameter of the small diameter portion 145B, and is smaller than the outer diameters of the large diameter portion 144B and the seal sections 147B, 148B. The small diameter portion 146B is attached to the distal end of the third tube 142B. The outer diameter of the small diameter portion 146B is larger than the inner diameter of the third tube 142B. Thus, the inner surface of the third tube 142B is brought in tight contact with the outer surface of the small diameter portion 146B so that no liquid leaks therefrom. This allows the ink in the storage chamber 141B to flow into the interior space of the connection unit 90B through the third tube 142B, the joint 143B, and the third attachment section 94B.

As depicted in FIG. 6B, the exterior cleaning liquid supply source 150 includes a storage chamber 151 storing cleaning liquid. The cleaning liquid stored in the storage chamber 151 is, for example, liquid composed of residual components of the ink from which colorant (pigment, dye, or the like) has been removed. Further, the fourth tubes 152B, 152Y, 152C, and 152M (examples of a fourth channel forming member), through which the cleaning liquid in the storage chamber 151 flows, lead from the exterior cleaning liquid supply source 150. The fourth channel through which the cleaning liquid passes is formed in each of the fourth tubes 152. The joints 153 attached to the distal ends of the fourth tubes 152 (the ends of the fourth tubes 152 on the downstream side in a cleaning liquid flow direction) have the same structure as that of the joint 143B, and thus any explanation of which will be omitted.

<Liquid Discharge Test Method>

An explanation will be made about a liquid discharge test method according to this embodiment with reference to FIG. 7 and FIGS. 8A to 8C. The liquid discharge test is a test for confirming as to whether or not the ink is discharged from the recording head 39 properly. In the following, the attachment and removal of respective tubes 31B, 32B, 142B, and 152B with respect to the connection unit 90B will be explained in detail, and the same operation will be performed on other connection units 90M, 90C, and 90Y.

Figure 8A:
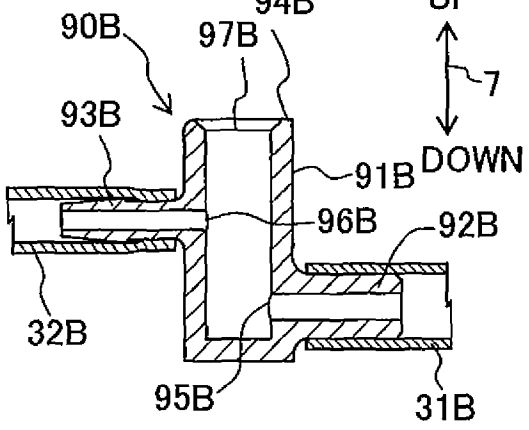

First, the first tube 31B is attached to the first attachment section 92B (S1). Specifically, as depicted in FIG. 8A, the first attachment section 92B is inserted into the first tube 31B. Then the inner surface of the first tube 31B is brought in tight contact with the outer surface of the first attachment section 92B so that no liquid leaks therefrom. This allows the first channel in the first tube 31B to communicate with the interior space of the connection unit 90B. The step S1 is an exemplary first attachment step.

Subsequently, the second tube 32B is attached to the second attachment section 93B (S2). Specifically, as depicted in FIG. 8A, the second attachment section 93B is inserted into the second tube 32B. Then the inner surface of the second tube 32B is brought in tight contact with the outer surface of the second attachment section 93B so that no liquid leaks therefrom. This allows the second channel in the second tube 32B to communicate with the interior space of the connection unit 90B. The step S2 is an exemplary second attachment step.

Figure 8B:
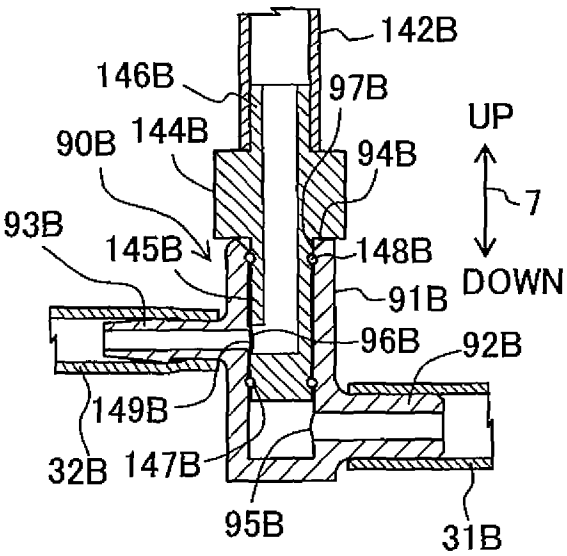

Subsequently, the third tube 142B is attached to the third attachment section 94B (S3). Specifically, as depicted in FIG. 8B, the small diameter portion 145B of the joint 143B is inserted downward into the cylindrical section 91B (the interior space of the connection unit 90B) through the opening 97B. This allows the third channel in the third tube 142B to communicate with the interior space of the connection unit 90B. The step S3 is an exemplary third attachment step.

In the step S3, in a case that the joint 143B is inserted so that the end surface of the large diameter portion 144B from which the small diameter portion 145B protrudes makes contact with the periphery of the opening 97B, the seal section 147B is brought in tight contact with the inner surface of the cylindrical section 91B so that no liquid leaks therefrom, at a position between the openings 95B and 96B in the up-down direction 7 (i.e., a position between the first attachment section 92B and the second attachment section 93B). Further, the seal section 148B is brought in tight contact with the inner surface of the cylindrical section 91B so that no liquid leaks therefrom, at a position between the openings 96B and 97B in the up-down direction 7 (i.e., a position between the second attachment section 93B and the third attachment section 94B). Further, the openings 96B and 149B are disposed at a position between the seal sections 147B and 148B in the up-down direction 7. That is, the step S3 includes a first blocking step to block the communication between the first channel in the first tube 31B and the second channel in the second tube 32B and a first communication step to allow the second channel in the second tube 32B to communicate with the third channel in the third tube 142B. Further, the leaking of ink from the interior space of the connection unit 90B through the opening 97B can be prevented.

Subsequently, the ink is discharged from the nozzles 40 by the recording head 39 (S4). For example, the ink may be discharged by the recording head 39 in accordance with the following procedure. Noted that the operation in the step S4 in which the ink is discharged by the recording head 39 is not limited to that the recording head 39 is made to perform the operation for discharging the ink (for example, the vibration of piezo elements), but includes the operation in which the ink in the nozzles 40 is sucked by the maintenance mechanism 80. The step S4 is an exemplary liquid discharge step.

First, the carriage 23 is moved to a position where the nozzle surface faces the cap 81, the cap 81 is moved to the cap position, and the pump 82 is driven (that is, the purge operation is performed). This discharges the air in the nozzles 40, the second channel of the second tube 32B, the interior space of the connection unit 90B, and the third channel of the third tube 142B. Then, the black ink stored in the storage chamber 141B of the exterior ink supply source 140 is supplied to the recording head 39 through the third channel of the third tube 142B, the interior space of the connection unit 90B, and the second channel of the second tube 32B, and then the supplied black ink is discharged from the nozzles 40.

The purge operation is performed until the third channel in the third tube 142B, the interior space of the connection unit 90B, the second channel in the second tube 32B, and the inside of each nozzle 40 are filled with the ink. After that, the ink is discharged from the nozzles 40 to form a predetermined pattern on a sheet 12 conveyed from the feed tray 20 by using the feed unit 15, the conveyance roller unit 54, and the discharge roller unit 55. Accordingly, a test pattern having the predetermined pattern is recorded on the sheet 12. Whether or not the ink is discharged by the recording head 39 properly is judged by observing the test pattern recorded on the sheet 12 visually or reading it by a sensor (not depicted).

Subsequently, the third tube 142B is removed from the third attachment section 94B (S5). Specifically, the small diameter portion 145B of the joint 143B is pulled out upwardly from the cylindrical section 91B through the opening 97B. The step S5 is an exemplary removal step. This releases the blocking state by the seal section 147B to allow the first channel to communicate again with the second channel. That is, the step S5 includes a second blocking step to block the communication between the second channel in the second tube 32B and the third channel in the third tube 142B and a second communication step to allow the first channel in the first tube 31B to communicate with the second channel in the second tube 32B.

Subsequently, the fourth tube 152B is attached to the third attachment section 94B (S6). This blocks the communication between the first channel in the first tube 31B and the second channel in the second tube 32B and allows the second channel in the second tube 32B to communicate with the fourth channel in the fourth tube 152B. The details of the step S6 are the same as those of the step S3, and thus any explanation of the step S6 will be omitted. The step S6 is an exemplary third communication step.

Subsequently, the ink is discharged from the nozzles 40 by the recording head 39 (S7). For example, the purge operation may be performed. During the purge operation, the ink in the nozzles 40, in the second channel of the second tube 32B, in the interior space of the connection unit 90B, and in the third channel of the third tube 142B is pushed out by the cleaning liquid supplied from the exterior cleaning liquid supply source 150. In other words, the inside of each nozzle 40, the second channel of the second tube 32B, the interior space of the connection unit 90B, and the third channel of the third tube 142B are filled with the cleaning liquid. The step S7 is an exemplary cleaning liquid discharge step.

Subsequently, the fourth tube 152B is removed from the third attachment section 94B (S8). The details of the step S8 are the same as those of the step S5, and thus any explanation of the step S8 will be omitted. The step S8 is another example of the removal step. The step S8 includes a third blocking step to block the communication between the second channel in the second tube 32B and the fourth channel in the fourth tube 152B and the second communication step to cause the first channel in the first tube 31B to communicate with the second channel in the second tube 32B.

Figure 8C:
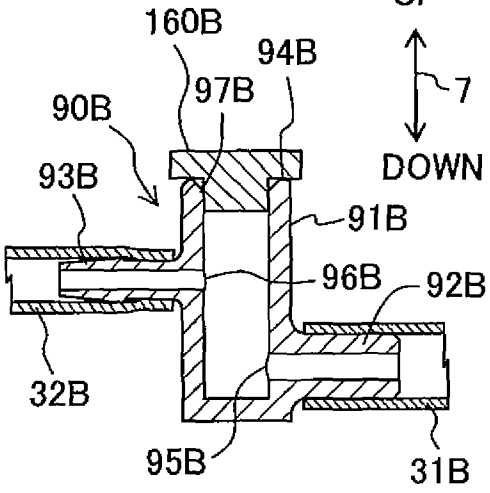

Then, as depicted in FIG. 8C, the cap 160B is attached to the third attachment section 94B (S9). This closes the opening 97B. The step S9 is an exemplary closing step. The cap 160B is made entirely of an elastic body such as rubber. The cap 160B has a portion inserted into the interior space of the cylindrical section 91B through the opening 97B, and the outer diameter of the portion is larger than the diameter of the inner surface of the cylindrical section 91B. Thus, in a case that the cap 160B is attached into the third attachment section 94B, the cap 160B is brought in tight contact with the inner surface of the cylindrical section 91B so that no liquid leaks therefrom. The multifunction peripheral 10 is shipped out in a state that each of the connection units 90 is in the state depicted in FIG. 8C and that the nozzle surface is capped with the cap 81. An image is recorded by the printer unit 11 based on a command inputted by a user (purchaser).

Figure 7:
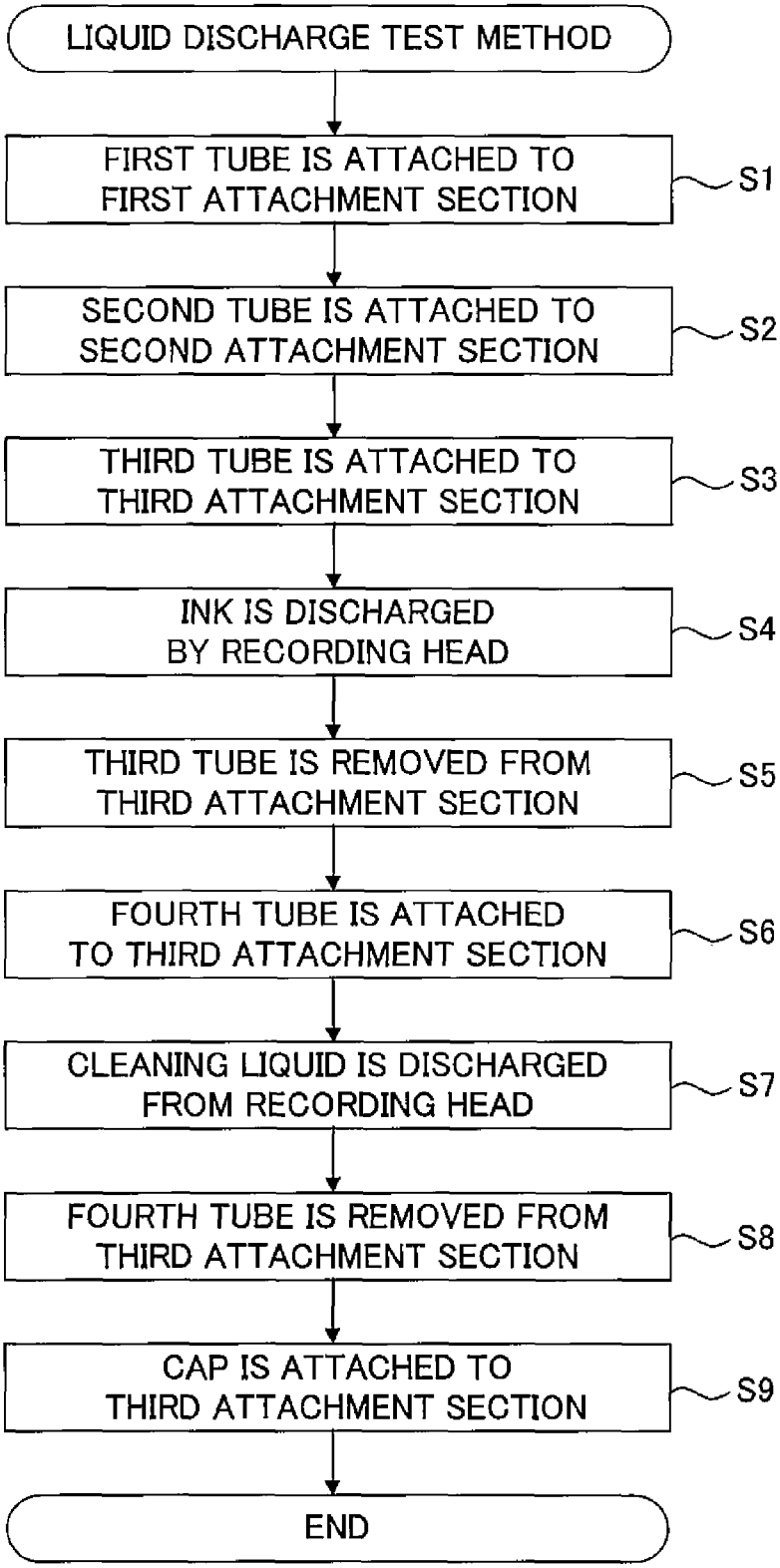
FIG. 7 is a flowchart indicating a procedure of a liquid discharge test method according to this embodiment.

The steps S1 to S3, S5, S6, S8, and S9 of FIG. 7 are executed manually. On the other hand, the steps S4 and S7 are executed by the controller. The multifunction peripheral 10 may display, for example, the procedure of an operation to be executed on a display (not depicted). Upon receiving the command (for example, the push of "OK" button) which indicates the completion of the operation through an operation unit (not depicted), the multifunction peripheral 10 may display the procedure of the operation to be executed next on the display or discharge the ink or cleaning liquid from the recording head 39.

<Technical Effect of the Embodiment>

According to the liquid discharge test method of the above embodiment, the ink supplied from the exterior ink supply source 140 through the second and third channels is discharged by the recording head 39. That is, the liquid discharge test can be performed without pouring the ink into the ink tank 100. Thus, the ink tank 100 of the multifunction peripheral 10 before shipment is never contaminated with the ink. This enables a purchaser of the multifunction peripheral 10 to use it without discomfort, and the channels in the ink tank 100 are never clogged with solidified ink. Further, the exterior ink supply source 140 can be used repeatedly, in other words, a plurality of multifunction peripherals 10 can share the exterior ink supply source 140 for the liquid discharge test. Therefore, it is possible to reduce a waste of ink as compared with the case in which the ink for the liquid discharge test is poured into the ink tank 100.

According to the above liquid discharge test method, the communication states of the first, second, third channels can be switched by attaching/removing the third tube 142B with respect to the third attachment section 94B. That is, the process of the liquid discharge test is simple. Although a small amount of ink could leak from the tip of the third tube 142B (in particular, the opening 149B) when the third tube 142B is attached/detached with respect to the cylindrical section 91B through the opening 97B provided on the upper surface of the cylindrical section 91B, most of the ink enters the interior space of the connection unit 90B through opening 97B. That is, the ink is prevented from leaking.

Figure 5:
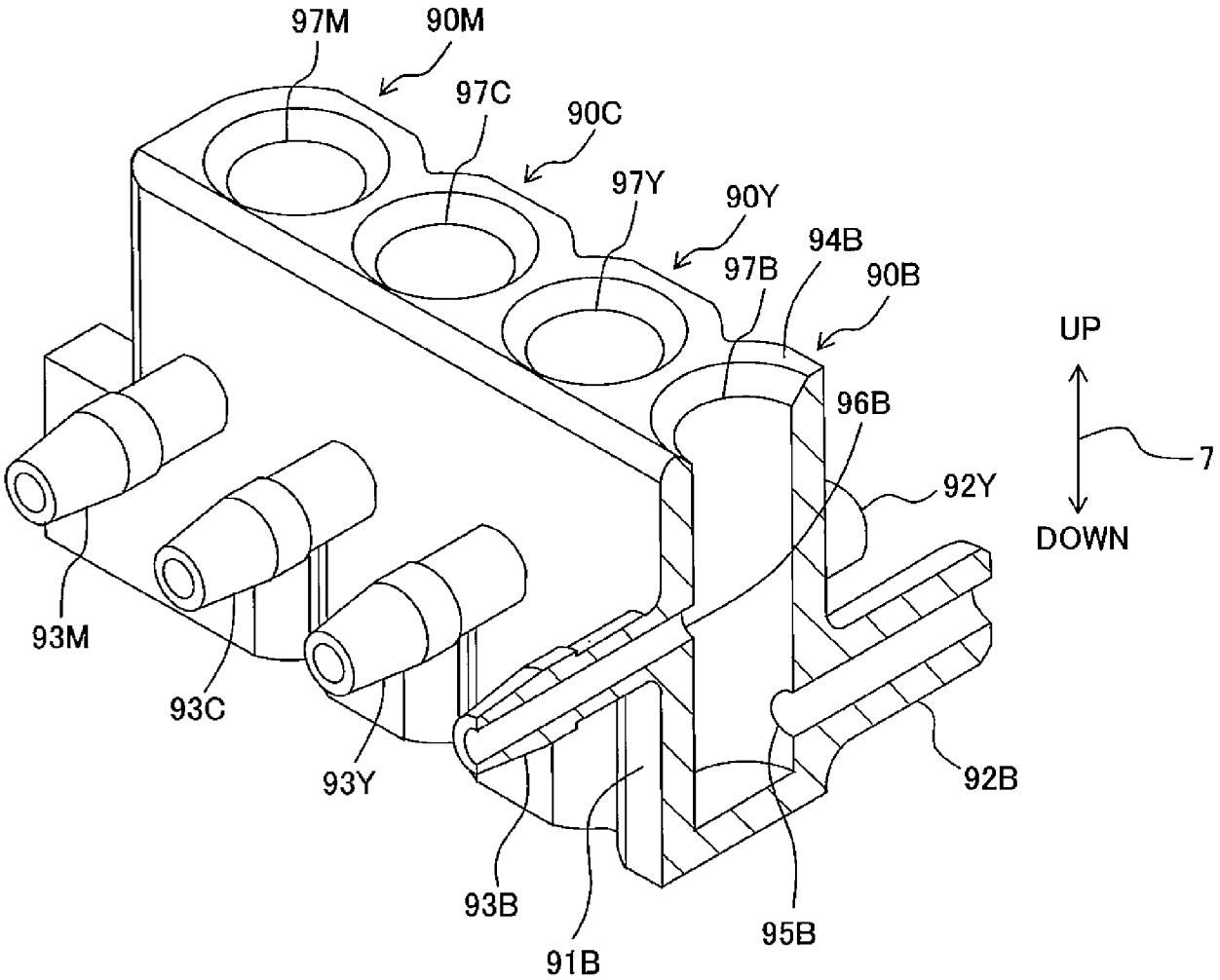
FIG. 5 is a cross-sectional perspective view of connection units 90.

The connection unit 90B can take any structure without being limited to examples depicted in FIGS. 5 and 8. For example, one of the openings 95B and 96B may be provided on the lower surface of the cylindrical section 91B. In other words, at least one of the first attachment section 92B and the second attachment section 93B may be provided on the side surface of the cylindrical section 91B. The connection unit 90B may be configured so that the switching of the communication state between the first channel and the second channel is performed independently from the switching of the communication state between the second channel and the third channel (or fourth channel).

According to the above liquid discharge test method, the ink, which was used for the liquid discharge test and has remained in the second channel and the recording head 39, is removed by discharging the residual ink together with the cleaning liquid from the recording head 39. That is, it is possible to clean the inside parts of the second channel and the recording head 39. However, the series of steps S6 to S8 for discharging the cleaning liquid by the recording head 39 are not indispensable and may be omitted.

Meanwhile, the purge operation may be also performed at the timing between the step S5 and the step S6. This allows the ink remained in the second channel and the recording head 39 to be discharged from the recording head 39 together with the air flowing therein through the opening 97B. As a result, it is possible to reduce the amount of the cleaning liquid used in the step S7. Further, the purge operation may be also performed at the timing between the step S8 and the step S9. This allows the cleaning liquid remained in the second channel and the recording head 39 to be discharged from the recording head 39. Furthermore, after the purge operation for discharging the cleaning liquid, the purge operation may be performed in a state that a fifth tube (not depicted), which leads from an exterior supply source for temporary filling liquid in which a temporary filling liquid is stored, is attached to the third attachment section 94B. The temporary filling liquid is a liquid to be filled in the recording head 39 at the time of shipment. The purge operation using the temporary filling liquid is performed in the same manner as the series of steps S6 to S8. The exterior supply source for temporary filling liquid may have the same structure as the exterior cleaning liquid supply source 150, and the fifth tube may have the same structure as the fourth tube 152B. The components of the temporary filling liquid may be the same as those of the cleaning liquid.

The explanation of the above embodiment has been made by citing the ink as an example of liquid. The present teaching, however, is not limited to this. That is, instead of the ink, it is allowable to use, as the liquid, a pretreatment liquid to be discharged on a recording sheet at the time of printing before the discharge of ink, water to be sprayed to the neighborhoods of the nozzles 40 of the recording head 39 to prevent the nozzles 40 from drying, or the like.

What is claimed is:

1. A liquid discharge test method using a liquid discharge apparatus, which includes a liquid storage tank and a liquid discharge unit configured to discharge a liquid, the method comprising:

blocking communication between a first channel in a first channel forming member extending from the liquid storage tank and a second channel in a second channel forming member extending from the liquid discharge unit;

allowing the second channel to communicate with a third channel in a third channel forming member extending from an exterior liquid supply source in which the liquid is stored;

discharging the liquid, which is supplied from the exterior liquid supply source through the third channel and the second channel, by the liquid discharge unit after blocking the communication between the first channel and the second channel and allowing the second channel to communicate with the third channel;

blocking the communication between the second channel and the third channel after discharging the liquid; and allowing the first channel to communicate with the second channel after discharging the liquid.

2. The liquid discharge test method according to claim 1, further comprising:

allowing the second channel to communicate with a fourth channel in a fourth channel forming member leading from an exterior cleaning liquid supply source in which a cleaning liquid is stored after blocking the communication between the second channel and the third channel;

discharging the cleaning liquid, which is supplied from the exterior cleaning liquid supply source thorough the fourth channel and the second channel, by the liquid discharge unit after allowing the second channel to communicate with the fourth channel; and blocking the communication between the second channel and the fourth channel after discharging the cleaning liquid by the liquid discharge unit.

3. The liquid discharge test method according to claim 1, wherein the liquid discharge apparatus further includes a communication unit having a first attachment section, a second attachment section, and a third attachment section through which an interior space of the communication unit communicates with an outside of the communication unit, the liquid discharge test method further comprising:

allowing the first channel to communicate with the interior space of the communication unit by attaching the first channel forming member to the first attachment section before blocking the communication between the first channel and the second channel;

allowing the second channel to communicate with the interior space of the communication unit by attaching the second channel forming member to the second attachment section before blocking the communication between the first channel and the second channel;

allowing the third channel to communicate with the interior space of the communication unit by attaching the third channel forming member to the third attachment section;

removing the third channel forming member from the third attachment section; and closing the third attachment section.

4. The liquid discharge test method according to claim 3, wherein the allowing the third channel to communicate with the interior space of the communication unit by attaching the third channel forming member to the third attachment section includes blocking the communication between the first channel and the second channel and allowing the second channel to communicate with the third channel; and the removing the third channel forming member from the third attachment section includes blocking the communication between the second channel and the third channel and allowing the first channel to communicate with the second channel.

5. The liquid discharge test method according to claim 4, wherein an opening and a seal section are formed on an outer surface of the third channel forming member, the opening allowing the third channel to communicate with an outside of the third channel forming member, the seal section being disposed at a position different from a position at which the opening is disposed;

the third channel forming member attached to the third attachment section blocks the communication between the first channel and the second channel by bringing the seal section in tight contact with an inner surface of the connection unit defining the interior space so that no liquid leaks therefrom at a position between the first attachment section and the second attachment section in an up-down direction; and allowing the second channel to communicate with the third channel through the opening.

6. The liquid discharge test method according to claim 5, wherein the connection unit further includes a cylindrical section of which axis direction extends in the up-down direction;

the first attachment section and the second attachment section are provided in the cylindrical section at positions different from each other in the up-down direction so that at least one of the first attachment section and the second attachment section is provided on a side surface of the cylindrical section;

the third attachment section is provided on an upper surface of the cylindrical section to define an opening through which the interior space of the connection unit is exposed; and the third channel forming member is removed upwardly from the cylindrical section through the opening defined by the third attachment section, in a case that the third channel forming member is removed from the third attachment section.

7. A liquid discharge apparatus configured to discharge a liquid, comprising:

a liquid storage tank;

a liquid discharge unit configured to discharge the liquid;

a first channel forming member extending from the liquid storage tank to include a first channel formed therein;

a second channel forming member extending from the liquid discharge unit to include a second channel formed therein; and a connection unit having a first attachment section, a second attachment section, and a third attachment section and being configured to allow an interior space of the connection unit to communicate with an outside of the connection unit through the first attachment section to which the first channel forming member is attached, the second attachment section to which the second channel forming member is attached, and the third attachment section which is closed by a removable closing member, wherein the connection unit is configured to allow the first channel of the first channel forming member attached to the first attachment section to communicate with the second channel of the second channel forming member attached to the second attachment section through the interior space.

8. The liquid discharge apparatus according to claim 7, wherein the connection unit further includes a cylindrical section of which axis direction extends in an up-down direction;

the first attachment section and the second attachment section are provided in the cylindrical section at positions different from each other in the up-down direction so that at least one of the first attachment section and the second attachment section is provided on a side surface of the cylindrical section; and the third attachment section is provided on an upper surface of the cylindrical section to define an opening through which the interior space of the connection unit is exposed.

* * * * *